US006267518B1

(12) United States Patent
Abe

(10) Patent No.: US 6,267,518 B1
(45) **Date of Patent: *Jul. 31, 2001**

(54) INK-JET PRINTING APPARATUS AND INK-JET PRINTING METHOD

(75) Inventor: Junkichi Abe, Tokyo (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/947,323

(22) Filed: Oct. 8, 1997

(30) Foreign Application Priority Data

Oct. 8, 1996 (JP) ..... 8-267041
Oct. 7, 1997 (JP) ..... 9-274301

(51) Int. Cl.[7] ..... B41J 3/60

(52) U.S. Cl. ..... 400/188; 347/3; 347/4; 347/5; 400/149

(58) Field of Search ..... 400/188, 149; 347/4, 5, 3

(56) References Cited

U.S. PATENT DOCUMENTS

| | | | | |
|---|---|---|---|---|
| 4,313,124 | | 1/1982 | Hara . | |
| 4,345,262 | | 8/1982 | Shirato et al. . | |
| 4,459,600 | | 7/1984 | Sato et al. . | |
| 4,463,359 | | 7/1984 | Ayata et al. . | |
| 4,558,333 | | 12/1985 | Sugitani et al. . | |
| 4,692,041 | * | 9/1987 | Dyma et al. | 400/188 |
| 4,723,129 | | 2/1988 | Endo et al. . | |
| 4,740,796 | | 4/1988 | Endo et al. . | |
| 5,452,959 | * | 9/1995 | Oka | 400/188 |
| 5,486,057 | * | 1/1996 | Skinner et al. | 400/188 |
| 5,488,458 | | 1/1996 | Benedict et al. . | |
| 5,558,449 | * | 9/1996 | Morgavi | 400/188 |
| 5,688,057 | * | 11/1997 | Wright et al. | 400/188 |
| 5,812,153 | * | 9/1998 | Watanabe et al. | 347/3 |

FOREIGN PATENT DOCUMENTS

| | | |
|---|---|---|
| 3431968 | 3/1985 | (DE) . |
| 0-331481 | 9/1989 | (EP) . |
| 0-380056 | 8/1990 | (EP) . |
| 0-382023 | 8/1990 | (EP) . |
| 0-422924 | 4/1991 | (EP) . |
| 0-477969 | 4/1992 | (EP) . |
| 0-622223 | 11/1994 | (EP) . |
| 0-646460 | 4/1995 | (EP) . |
| 0659569 | 6/1995 | (EP) . |
| 0677392 | 10/1995 | (EP) . |
| 0700788 | 3/1996 | (EP) . |
| 0711063 | 5/1996 | (EP) . |
| 726156 | 8/1996 | (EP) . |
| 62-53492 | 3/1987 | (JP) . |
| 3-46589 | 12/1987 | (JP) . |
| 52-12851 | 8/1993 | (JP) . |
| 06055731 | 1/1994 | (JP) . |
| 90-70990 | 3/1997 | (JP) . |

OTHER PUBLICATIONS

"Duplex Printing with a Band Printer", J.E. Drejza, IBM Technical Disclosure Bulletin, vol. 23, No. 9, Feb. 1981, pp. 4101–4103, XP–002089440, New York.

* cited by examiner

*Primary Examiner*—Ren Yan
*Assistant Examiner*—Charles H. Nolan, Jr.
(74) *Attorney, Agent, or Firm*—Fitzpatrick, Cella, Harper & Scinto

(57) ABSTRACT

A first printing unit for forming a front image on one surface and a second printing unit forming a back image on the other surface are respectively constructed with two stages of printing heads. With respect to the image formed on one surface of a printing medium by the first printing unit, the image formed on the other surface of the printing medium by the second printing unit is formed as a mirror image of bilateral symmetry about an axis in a transporting direction so that the image on the other surface is consistent with the image on one surface.

13 Claims, 8 Drawing Sheets

INK-JET PRINTING APPARATUS AND INK-JET PRINTING METHOD

BACKGROUND OF THE INVENTION

1. Field of the Invention

The present invention relates to an ink-jet printing apparatus and an ink-jet printing method, particularly suitable for textile printing, which employs textile or cloth as a printing medium, and ejects an ink to the textile by means of an ink-jet head as a printing head.

2. Description of the Related Art

In the recent years, there have been known ink-jet printing apparatuses performing textile printing employing an ink-jet type printing system. Different from the conventional screen textile printing, this type of textile printing apparatus achieves advantages because an original plate is not required, a freedom of image to be printed is high, and overall cost for textile printing can be low.

Japanese Patent Application Laid-Open No. 212851/1993 discloses one embodiment of a textile printing apparatus employing an ink-jet system. As can be clear from FIG. 2 of the above-identified publication, this type of textile printing apparatus performs printing by ejecting an ink from an ink-jet head to a textile as a printing medium, transported in a vertical direction. In a printing portion performing ink ejection, a printing unit having the ink-jet head and a transporting mechanism including a metallic endless belt, i.e., a transporting belt, are arranged in opposition across the textile.

The textile is adhered on the surface of the transporting belt to maintain flatness. Then, by intermittently driving the transporting belt, the textile is transported for a predetermined width.

The textile is printed per one printing width by the known serial printing system, and thereafter is applied an appropriate tension by a textile take-up roller arranged at the most downstream side of the transporting path. Then, at an end portion of the transporting belt, the textile is peeled off the transporting belt and taken up on the take-up roller via a textile path.

Next, after printing, immediately after peeling off the transporting belt, a drying process is performed on the textile for the ink in the printing portion of the textile by means of a drying process apparatus. For the drying process apparatus, a system blowing hot air on the printing surface of the textile or a system irradiating an infrared ray on the printing surface of the textile may be selected arbitrarily. Such drying processes are particularly effective when a liquid state printing agent is employed.

On the other hand, a textile printing ink applied to the textile by the ink-jet type textile printing merely adheres on the textile. It is required to fix the coloring agent in the ink, such as dye by making impregnation. It is typical for a rough standard of impregnation amount to be evaluated by the strike through amount (permeation amount of the ink towards the back side of textile printing surface) by observation from the back side as the non-printed surface. In the case of the ink-jet textile printing, in which the application amount of the ink, such as dye, is smaller in comparison with the conventional screen textile printing, an effort is often made to compensate for the shorting of the strike through amount by overlapping printing.

However, when reciprocating overlapping printing is performed by the same printing head in order to increase the strike through amount, productivity is lowered in a manner inversely proportional to the number of times of overlapping printing. As a result, a cost for printed textile is increased.

On the other hand, overlapping printing by a plurality of stages of printing heads, greater than or equal to three stages, increases the cost for a textile printing apparatus in proportion to the number of steps of the printing heads.

SUMMARY OF THE INVENTION

It is an object of the present invention to provide an ink-jet printing apparatus and an ink-jet printing method, which can form a clear image by realizing maximization of strike through amount of the dye ink with minimum printing head construction without lowering productivity.

In a first aspect of the present invention, there is provided an ink-jet printing apparatus forming an image on a printing medium by employing a printing head, comprising:

transporting means for transporting the printing medium;

first printing means provided in opposition to one surface of the printing medium transported by the transporting means and forming a image on the one surface by applying a printing agent on the one surface of the printing medium by means of a printing head;

second printing means provided in opposition to the other surface of the printing medium transported by the transporting means and forming a image on the other surface by applying a printing agent on the other surface of the printing medium by means of a printing head; and both surface registration control means for performing registration of the image on the one surface and the image on the other surface so that the image formed on the other surface of the printing medium by the second printing means is consistent with the image formed on one surface of the printing medium by the first printing means.

In a second aspect of the present invention, there is provided an ink-jet printing method comprising:

a transporting step of transporting a printing medium;

an image on one surface forming step of performing formation of a image on one surface by applying a printing agent on one surface of the printing medium transported in the transporting step, employing a first printing means arranged in opposition to the one surface of the printing medium;

an image on the other surface forming step of performing formation of an image on the other surface by applying a printing agent on the other surface of the printing medium transported in the transporting step, employing a second printing means arranged in opposition to the other surface of the printing medium;

a registration step of performing registration of the image on the one surface and the image on the other surface so that the image formed on the other surface of the printing medium by the second printing means is consistent with the image formed on one surface of the printing medium by the first printing means.

The above and other objects, effects, features and advantages of the present invention will become more apparent from the following description of embodiments thereof taken in conjunction with the accompanying drawings.

DETAILED DESCRIPTION OF PREFERRED EMBODIMENT

Preferred embodiments of the present invention will be described in detail with reference to the drawings.

A first embodiment of the present invention will be described with reference to FIGS. 1, 2, 3 and 4.

Figure 1:
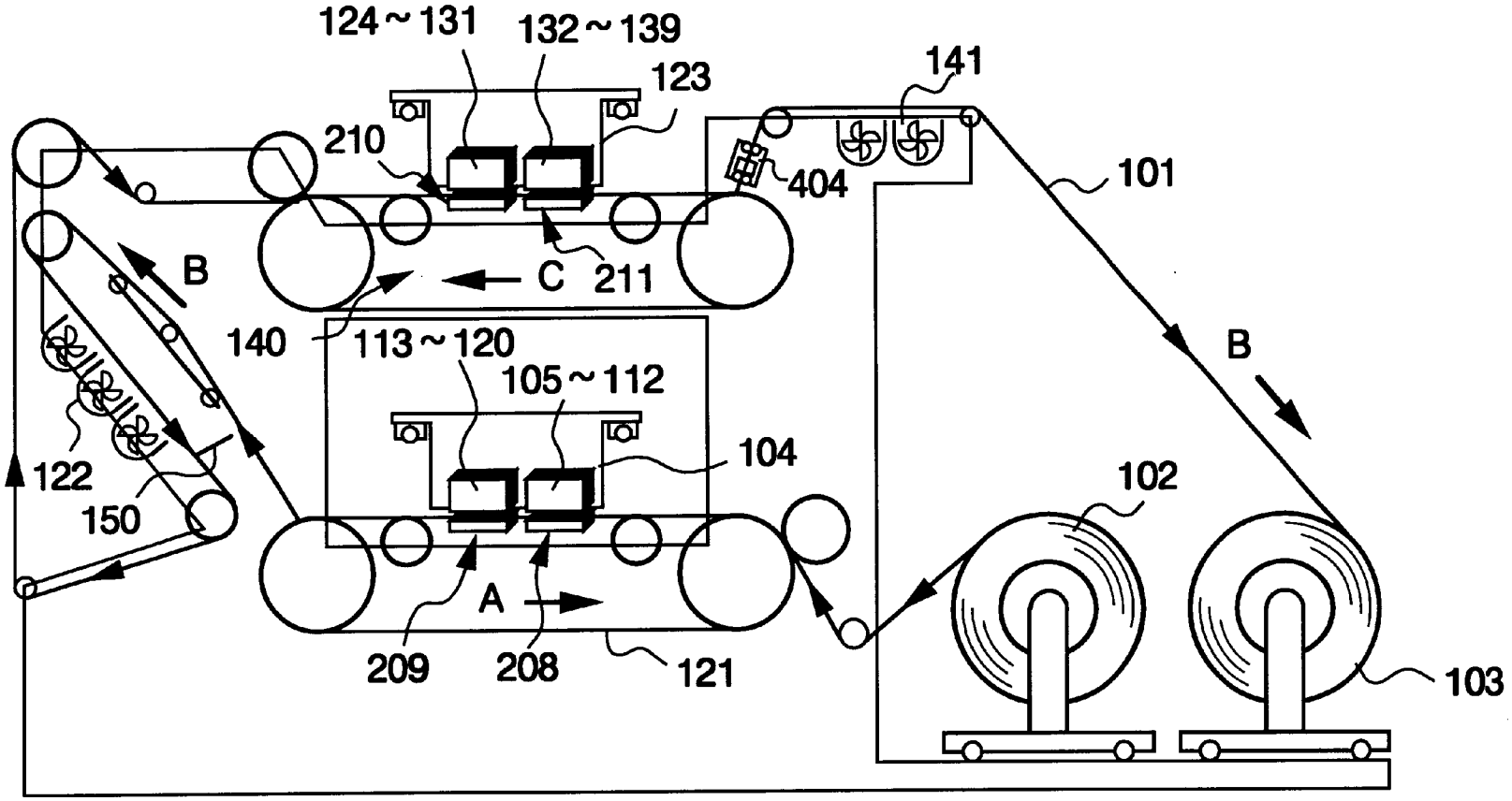
FIG. 1 is a sectional view showing a general construction of a full-color ink-jet textile printing apparatus as a first embodiment according to the present invention.

This embodiment is a textile printing apparatus employing an ink-jet system. FIG. 1 shows a brief construction of a full-color ink-jet textile printing apparatus.

A reference numeral 101 denotes a printing medium consisting of a textile, such as cotton, silk, nylon, polyester, and the like. A reference numeral 102 denotes a feed roller on which the printing medium 101 is wound in roll form. A reference numeral 103 denotes a take-up roller for taking up a printing medium 101 being printed.

A reference numeral 104 denotes a first printing control unit (a first printing means). This first printing control unit 104 controls a first printing head 208 and a second printing head 209.

The first printing head 208 is constructed with ink-jet heads 105 to 112, which are positioned at an upstream side of the transporting path of the printing medium 101. A reference numeral 105 denotes a first pale magenta multi-nozzle head (a first pale magenta head) for ejecting a pale magenta ink. A reference numeral 106 denotes a first yellow multi-nozzle head (a first yellow head) for ejecting a yellow ink. A reference numeral 107 denotes a first orange multi-nozzle head (a first orange head) for ejecting an orange ink. A reference numeral 108 denotes a first magenta multi-nozzle head (a first magenta head) for ejecting a magenta ink. A reference numeral 109 denotes a first pale cyan multi-nozzle head (a first pale cyan head) for ejecting a pale cyan ink. A reference numeral 110 denotes a first cyan multi-nozzle head (a first cyan head) for ejecting a cyan ink. A reference numeral 111 denotes a first blue multi-nozzle head (a first blue head) for ejecting a blue ink. A reference numeral 112 denotes a first black multi-nozzle head (a first black head) for ejecting a black ink.

Each of ink-jet heads 105 to 112 has a plurality of ejection openings and the length of the head parallels the transporting direction Y of the printing medium 101. These ink-jet heads 105 to 112 are sequentially arranged along the main-scanning direction Xa.

A second printing head 209 is constructed with ink-jet heads 113 to 120, which are positioned at a downstream side of a transporting path of the printing medium 101 and are shifted half of printing width (band width) in the transporting direction with respect to ink-jet heads 105 to 112.

A reference numeral 113 denotes a second pale magenta multi-nozzle head (a second pale magenta head) for ejecting a pale magenta ink. A reference numeral 114 denotes a second yellow multi-nozzle head (a second yellow head) for ejecting a yellow ink. A reference numeral 115 denotes a second orange multi-nozzle head (a second orange head) for ejecting an orange ink. A reference numeral 116 denotes a second magenta multi-nozzle head (a second magenta head) for ejecting a magenta ink. A reference numeral 117 denotes a second pale cyan multi-nozzle head (a second pale cyan head) for ejecting a pale cyan ink. A reference numeral 118 denotes a second cyan multi-nozzle head (a second cyan head) for ejecting a cyan ink. A reference numeral 119 denotes a second blue multi-nozzle head (a second blue head) for ejecting a blue ink. A reference numeral 120 denotes a second black multi-nozzle head (a second black head) for ejecting a black ink.

Each of ink-jet heads 113 to 120 has a plurality of ejection openings and the length of the head parallels the transporting direction Y of the printing medium 101. These ink-jet heads 113 to 120 are sequentially arranged along the main-scanning direction Xa.

A reference numeral 121 denotes a first platen (first transporting means) transporting the printing medium. This first platen 121 is stretched by a plurality of rollers and moved in the direction shown by arrow A to transport the printing medium 101 in the direction shown by arrow B by friction with the printing medium 101. A reference numeral 122 denotes a dryer for drying the ink on the printing surface of the printing medium 101 immediately after printing. The dried printing medium 101 is turned over by the transporting means (both surface return means) to reverse the transporting direction. Therefore, the back side surface of the printing medium 101 is located at the upper position and the front side surface of the dried printing medium 101 is located at the lower position.

A reference numeral 123 denotes a second printing control unit (a second printing means). This second printing control unit 123 controls a third printing head 210 and a forth printing head 211.

The third printing head 210 is constructed with ink-jet heads 124 to 131, which are positioned at an upstream side of the transporting path of the printing medium 101. A reference numeral 124 denotes a third pale magenta multi-nozzle head (a third pale magenta head) for ejecting a pale magenta ink. A reference numeral 125 denotes a third yellow multi-nozzle head (a third yellow head) for ejecting a yellow ink. A reference numeral 126 denotes a third orange multi-nozzle head (a third orange head) for ejecting an orange ink. A reference numeral 127 denotes a third magenta multi-nozzle head (a third magenta head) for ejecting a magenta ink. A reference numeral 128 denotes a third pale cyan multi-nozzle head (a third pale cyan head) for ejecting a pale cyan ink. A reference numeral 129 denotes a third cyan multi-nozzle head (a third cyan head) for ejecting a cyan ink. A reference numeral 130 denotes a third blue multi-nozzle head (a third blue head) for ejecting a blue ink. A reference numeral 131 denotes a third black multi-nozzle head (a third black head) for ejecting a black ink.

Each of ink-jet heads 124 to 131 has a plurality of ejection openings and the length of the head parallels the transporting direction Y of the printing medium 101. These ink-jet heads 124 to 131 are sequentially arranged along the main-scanning direction Xa.

A forth printing head 211 is constructed with ink-jet heads 132 to 139, which are positioned at a downstream side of a transporting path of the printing medium 101 and are shifted half of printing width (bandwidth) in the transporting direction with respect to ink-jet heads 124 to 131.

A reference numeral 132 denotes a forth pale magenta multi-nozzle head (a forth pale magenta head) for ejecting a pale magenta ink. A reference numeral 133 denotes a forth yellow multi-nozzle head (a forth yellow head) for ejecting a yellow ink. A reference numeral 134 denotes a forth orange multi-nozzle head (a forth orange head) for ejecting an orange ink. A reference numeral 135 denotes a forth magenta multi-nozzle head (a forth magenta head) for ejecting a magenta ink. A reference numeral 136 denotes a forth pale cyan multi-nozzle head (a forth pale cyan head) for ejecting a pale cyan ink. A reference numeral 137 denotes a forth cyan multi-nozzle head (a forth cyan head) for ejecting a cyan ink. A reference numeral 138 denotes a forth blue multi-nozzle head (a forth blue head) for ejecting a blue ink. A reference numeral 139 denotes a forth black multi-nozzle head (a forth black head) for ejecting a black ink.

Each of ink-jet heads 132 to 139 has a plurality of ejection openings and the length of the head parallels the transporting direction Y of the printing medium 101. These ink-jet heads 132 to 139 are sequentially arranged along the main-scanning direction Xa.

A reference numeral 140 denotes a second platen (second transporting means) for transporting the printing medium. This second platen 140 is stretched by a plurality of rollers and moved in a direction shown by an arrow C to transport the printing medium 101 in a direction shown by arrow B by friction with the printing medium 101. A reference numeral 141 denotes a dryer for drying the ink on the printing surface of the printing medium immediately after printing.

Figure 2:
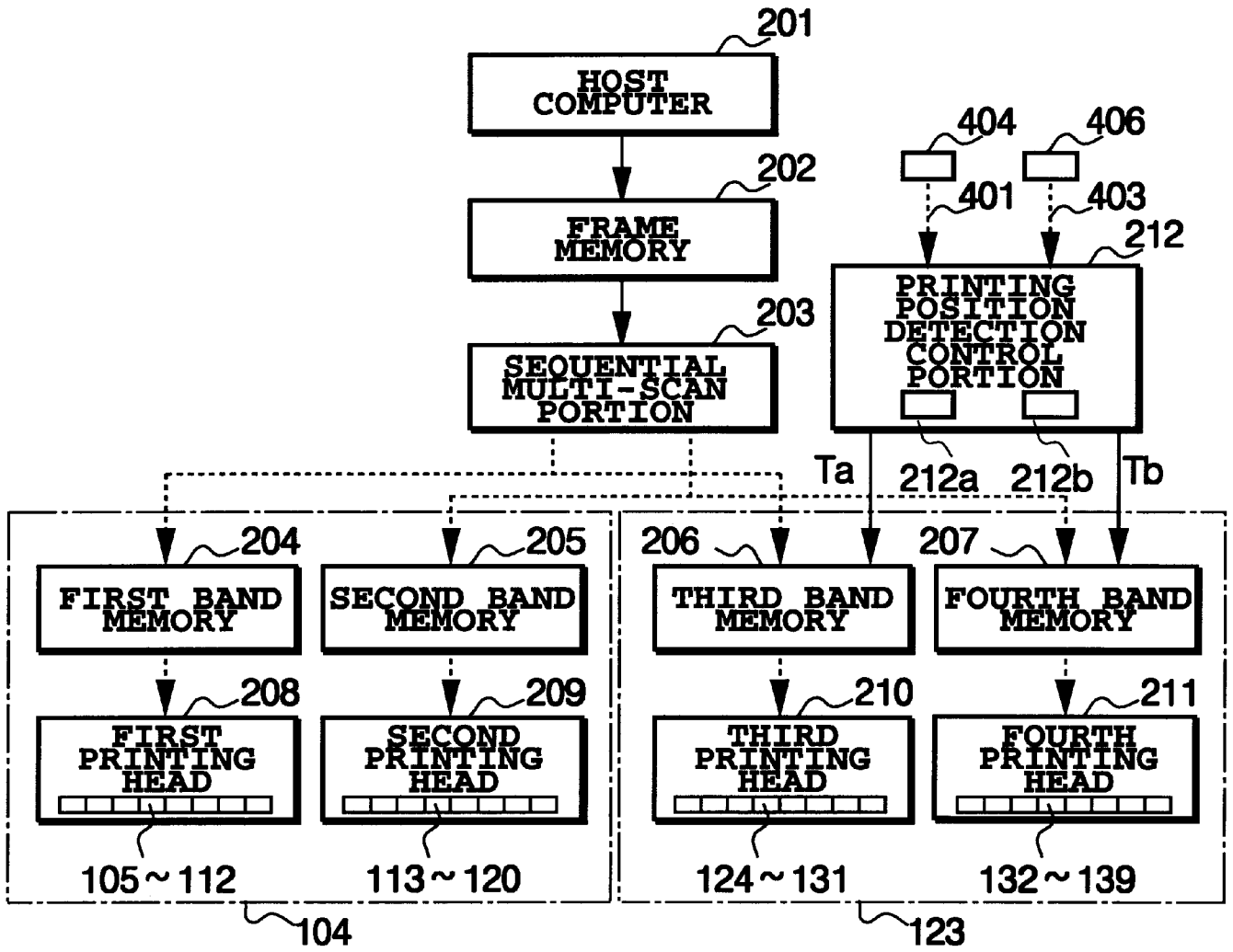
FIG. 2 is a block diagram showing a flow of image data processing in the full-color ink-jet textile printing system.

FIG. 2 shows a construction of a circuit portion performing a printing process in the ink-jet textile printing system. Here, the first printing head 208, the second printing head 209, the third printing head 210 and the fourth printing head 211 perform bi-directional printing.

The reference numeral 201 denotes a host computer controlling the ink-jet type textile printing system. Printing image data transferred from the host computer 201 via a general purpose interface bus (GPIB) interface, is stored in a frame memory 202 and is sequentially read out to a sequential multi-scanning portion 203 by generating a printing start command. The sequential multi-scanning portion 203 distributingly transfers the printing image data received from the frame memory 202 to a first band memory 204 and a second band memory 205. In conjunction therewith, the printing image data received from the frame memory 292 is distributingly transferred to the third band memory 206 and the fourth band memory 207.

Figure 3:
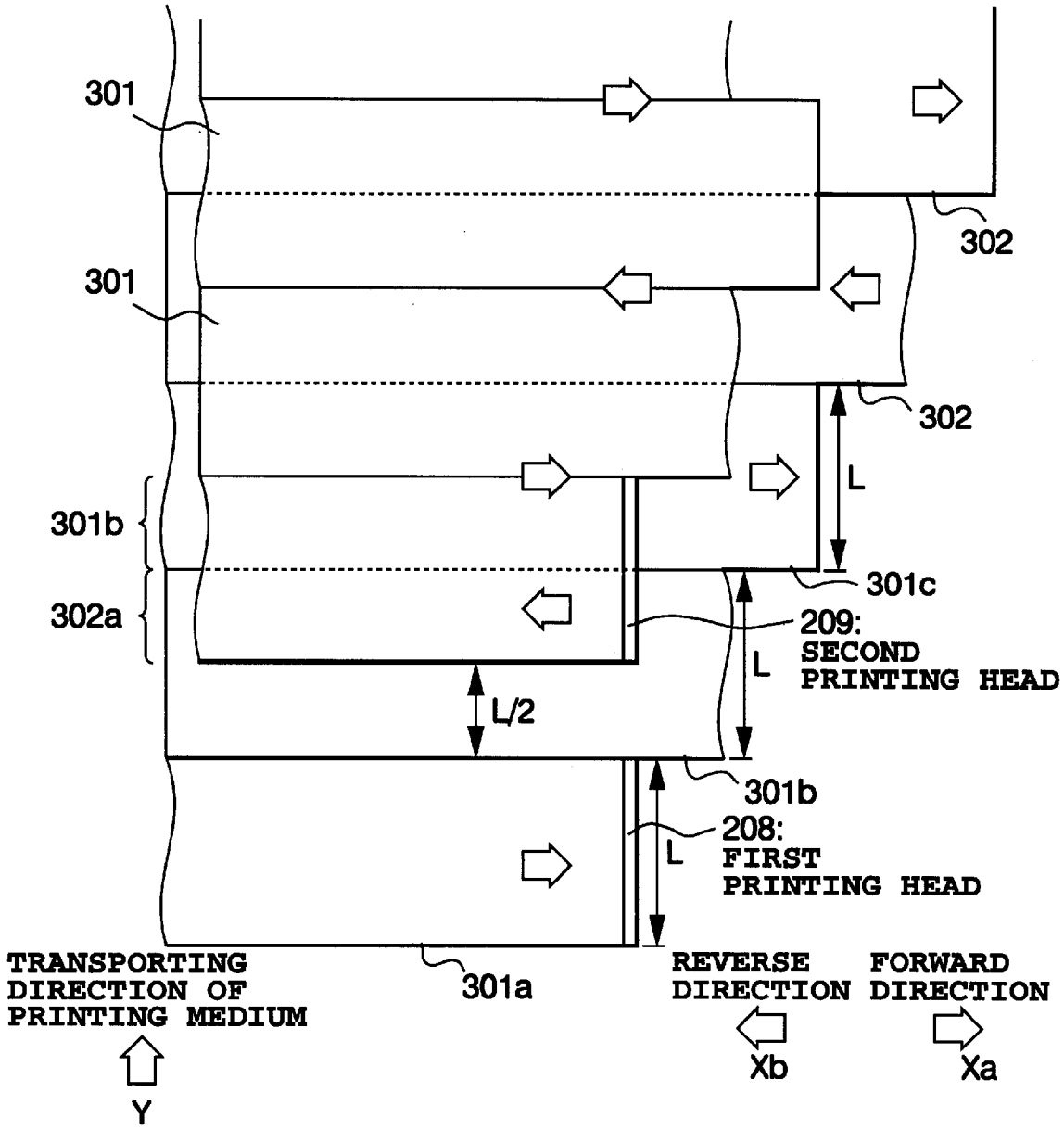
FIG. 3 is a schematic view for explaining a printing method using sequential multi-scanning in the ink-jet textile printing apparatus.

Next, FIG. 3 is an illustration for explaining a printing process of the first printing controller portion 104 in the ink-jet textile printing apparatus in FIGS. 1 and 2.

Here, the first printing head 208 connected to the first band memory 204 is positioned at an upstream side of the transporting direction Y of the printing medium 101 and thus performs first printing for the printing medium 101.

It should be noted that, in FIG. 3, the first printing head 208 includes all of the ink-jet heads 105 to 112, and the second printing head 209 includes all of the ink-jet heads 113 to 120.

Upon printing, printing operation is performed depending upon the printing data of the first band memory 204 distributed by the sequential multi-scanning portion 203 (Japanese Patent Application Laid-Open No. 70990/1997). Then, the portion 301*a* of the printing medium which is printed during scanning in the forward direction Xa employing all of the ejection openings of the first printing head 208 is transported by a predetermined amount corresponding to an arrangement width L of the ejection openings of the printing head to be placed in a region corresponding to a printing region of the second printing head 209. On the basis of the remaining second printing data distributed to the region 301*b* according to the multi-scanning system, printing is performed by the second printing head 209. However, as set forth above, the first printing head 208 and the second printing head 209 are mutually shifted in their printing positions in a magnitude corresponding to one half of the arrangement width L of the ejection openings. Therefore, the second printing head 209 performs printing during scanning in the reverse direction Xb for a region 302*a* corresponding to the upper half of the region 301*b* where printing has already been performed by the first printing head 208.

Next, the printing medium 101 is transported for an amount corresponding to the arrangement width L of the ejection openings, and then the region 301*b* of the printing medium 101 reaches a region 301*c*. Then, by using the ejection openings in the upper half of the second printing head 209, the lower half of the region 301*b* of the region 301*c* printed by the first printing head 208. As set forth above, the regions printed by the first printing head 208 and the second printing head 209 can be represented by the reference numeral 302. It should be noted that, the printing data upon printing means the data for printing by thinning dots to be printed in staggered fashion and data not performing printing (data not performing ejection) is provided for the thinned portion.

As described above, in the embodiment shown, the multi-scanning system is employed, so that respective lines of the regions 302 are formed by inks ejected from respectively different ejection openings of the first printing head 208 and the second printing head 209. Thus, fluctuation of density, stripe or so forth due to the diameter of ejection openings, direction of ejection of the ink-jet head and so forth can be distributed.

On the other hand, even in the second printing control portion 123, similar to the operation of the first printing control portion 104, control is performed for the third printing head 210 and the fourth printing head 211.

Figure 4:
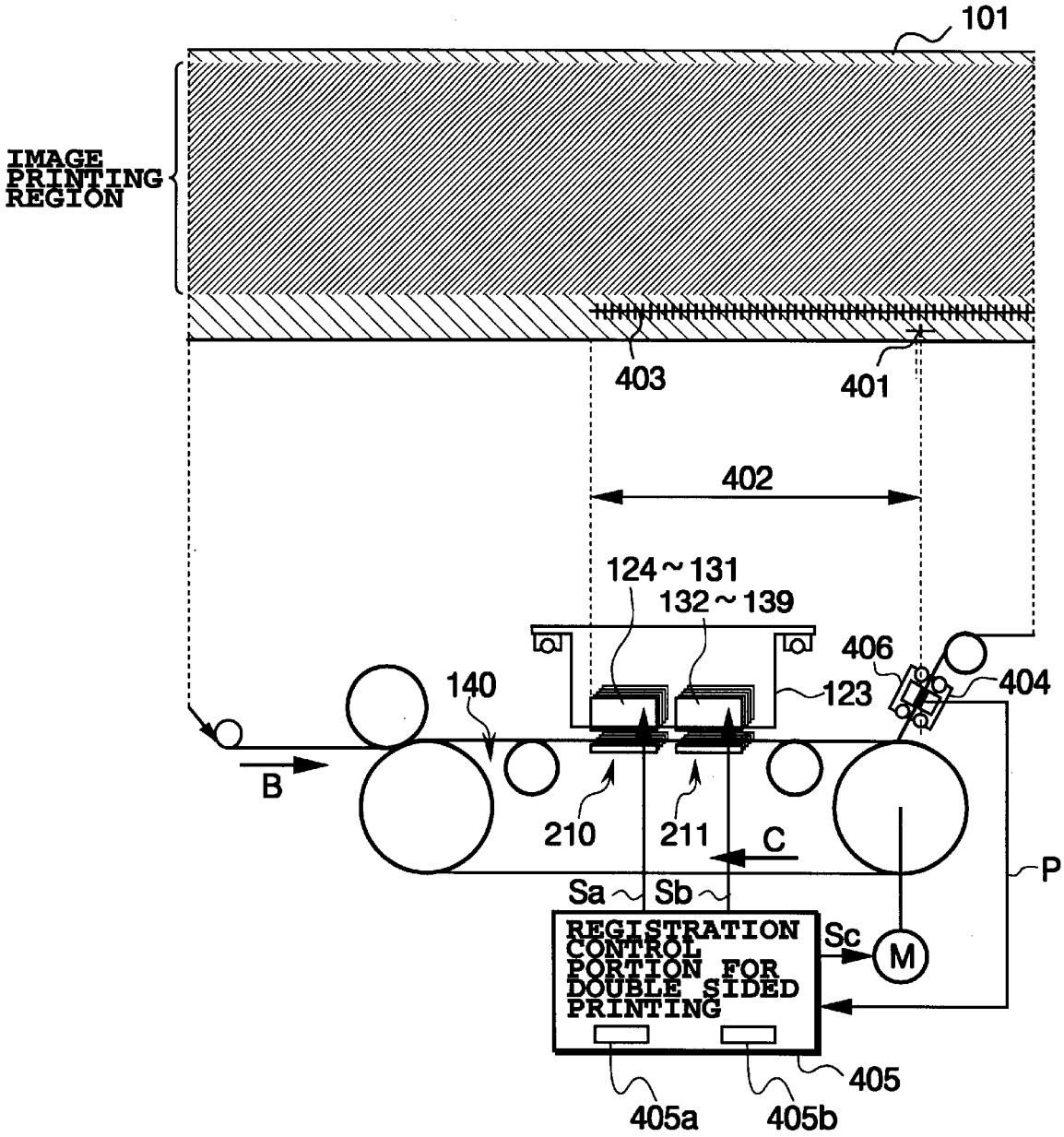
FIG. 4 is a schematic view for explaining a registration control method between the front side surface and the back side surface in the ink-jet textile printing apparatus.

Next, FIG. 4 is an illustration for explaining a double sided printing process for realizing good strike through by printing mirror images on the both surfaces by the ink-jet textile printing apparatus in FIGS. 1 and 2.

In order to perform a double sided printing process, it becomes necessary to perform registration control between the front side surface and the back side surface with respect to the transporting direction Y and the carriage scanning directions Xa and Xb. Registration control with respect to the transporting direction Y is performed by using a registration control portion 405 for performing registration control for double sided printing as shown in FIG. 4. On the other hand, registration control with respect to the carriage scanning directions Xa and Xb, can be performed by a printing position detection control portion 212 as shown in FIG. 2.

At first, explanation will be given with respect to registration control in the transporting direction Y.

Figure 5:
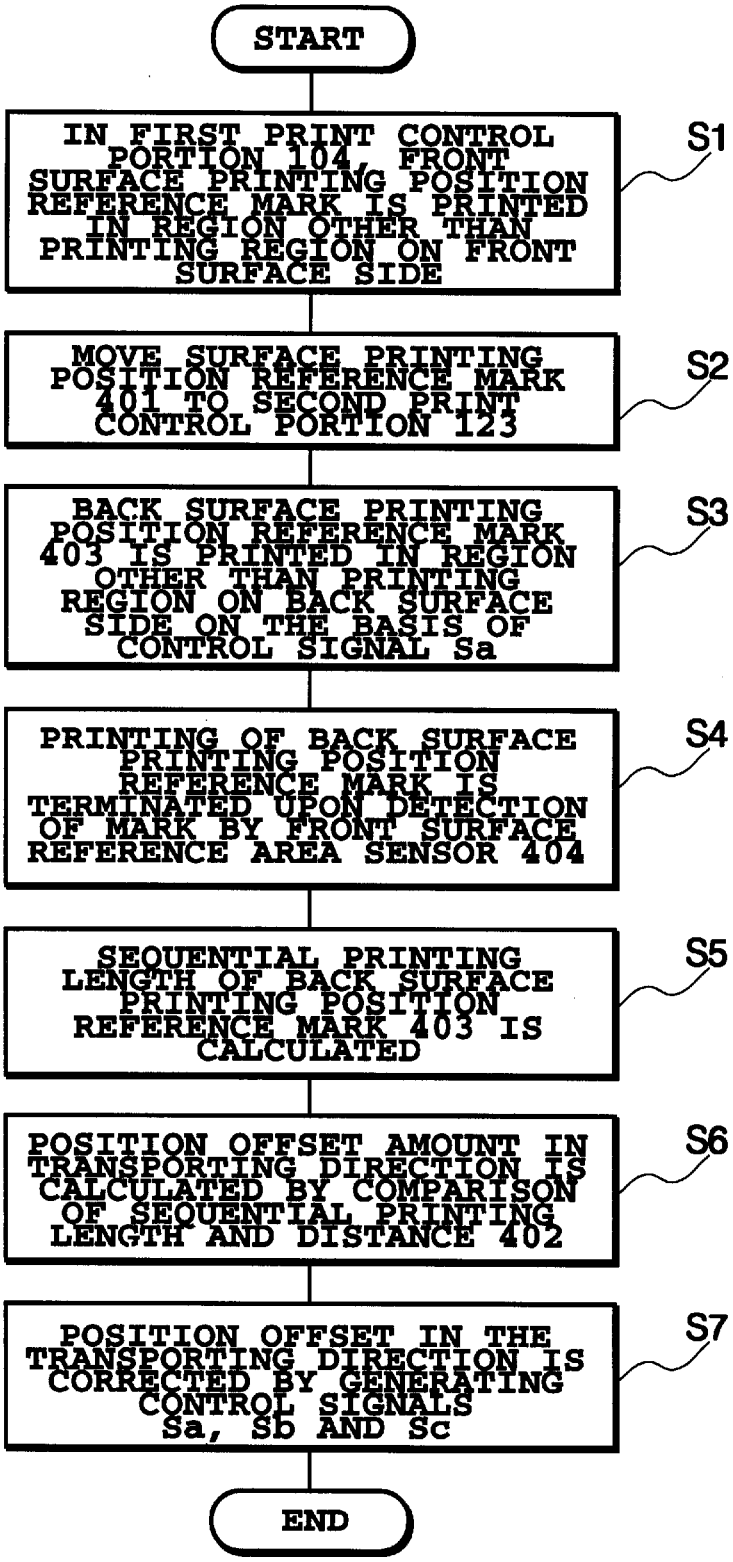
FIG. 5 is a flowchart for explaining a control process of correcting offset of a printing position at the front side surface and the back side surface with respect to the transporting (sub-scanning) direction.

The registration control portion 405 for the double sided printing as shown in FIG. 4 includes a CPU 405*a*, a ROM 405*b*, and the like. The CPU 405*a* performs arithmetic processing associated with the registration control. The ROM 405*b* stores a control program for registration control. FIG. 5 is a flowchart for explaining the control program performing registration control.

Explanation will be given hereinafter for method for performing registration control with respect to the transporting direction Y and correcting offset of printing positions at the front side surface and the back side surface by using the registration control portion 405 for double sided printing, with reference to the flowchart of FIG. 5.

In advance of printing of the image data, by employing the first printing head 208 of the first printing control portion 104 shown in FIG. 1, a front surface printing position reference mark 401 is printed in a region other than an image printing region on the front surface side (step S1). After printing the front surface side printing position reference mark 401, printing of the image data is initiated from a position transported for a distance greater than or equal to a distance 402 between the third printing head 210 and a front side surface reference area sensor 404, using the first printing head 208. The printing medium 101, on which the front surface side printing position reference mark 401 is printed, is transported to a region of the second print control portion 123 as shown in FIG. 4 (step S2).

FIG. 4 shows a manner of printing on the back side surface of the printing medium. The registration control portion 405 for a double sided printing feeds a control signal Sa for the third printing head 210. On the basis of the control signal Sa, the third printing head repeats printing of a back side surface printing position reference mark 403 in a region other than an image printing region on the back side surface (step S3). Subsequently, upon detection of the front side surface printing position reference mark 401, sequential printing of the back side surface printing position reference mark 403 by the third printing head 210 is terminated (step S4). By using the back side surface reference area sensor 406, a signal P indicative of a length of sequential printing of the back side surface printing position reference mark 403 from a timing where the front side surface printing position reference mark 401 to the terminating position of sequential printing of the back side surface printing position reference mark 403 is detected. The detected signal P is fed to the registration control portion 405 for the double sided printing.

In the registration control portion 405 for the double sided printing, by employing the control program stored in the ROM 405*b*, a sequential printing length of the back side surface printing position reference mark 403 is calculated on the basis of the detected signal P (step S5). Then, by comparing the sequential printing length of the back side surface printing position reference mark 403 thus calculated with the distance 402 in the transporting direction (distance between the third printing head 210 and the front side surface area sensor 404), a position offset amount of the third printing head 210 is derived (step S6). The position offset amount corresponds to the offset amount of the printing positions at the front side surface and the reverse side surface in the transporting direction Y.

Then, in the registration control portion 405 for the double sided printing, on the basis of the position offset amount thus calculated, the control signals Sa and Sb and a motor control signal Sc are generated. Rotation control of the second platen 140 is performed based on the motor control signal Sc. In conjunction therewith, ink ejection timings of the third printing head 210 and the fourth printing head 211 are controlled on the basis of the control signals Sa and Sb (step S7). By this control, position offset of the printing positions on the front side surface and the back side surface in the transporting direction Y can be corrected. It should be noted that, as a cause of the offset in the transporting direction, position error possibly caused in assembling the printing head and the like can be considered.

Figure 6:
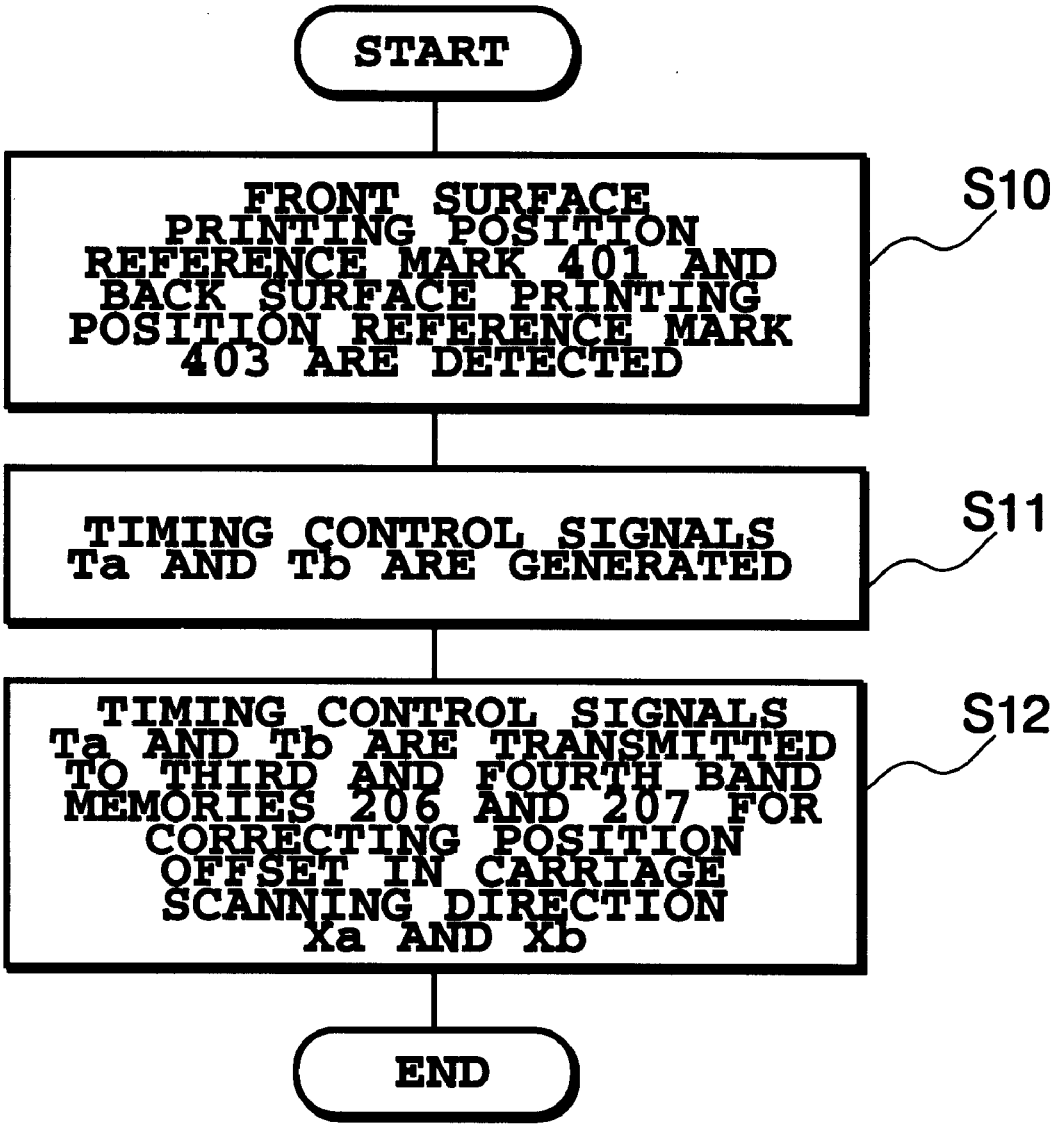
FIG. 6 is a flowchart for explaining a control process of correcting offset of a printing position at the front side surface and the back side surface with respect to the carriage scanning (main-scanning) direction.

Next, a method for correcting offset of the printing positions on the front side surface and the back side surface through performing registration control with respect to the carriage scanning directions Xa and Xb by the printing position detection control portion 212 will be described with reference to a flowchart shown in FIG. 6.

The printing position detection control portion 212 as shown in FIG. 2 incorporates a CPU 212*a*, a ROM 212*b*, and the like. The ROM 212*b* stores a control program for registration control. FIG. 6 is a flowchart for explaining control program performing registration control.

First, the position of the front side surface printing position reference mark 401 is detected by the front side surface reference area sensor 404, and the position of the back side surface printing position reference mark 403 is detected by the back side surface reference area sensor 406 (step S10).

The position signals thus detected are fed to the printing position detection control portion 212. In the printing position detection control portion 212, an arithmetic process is performed for generating timing control signals Ta and Tb for adjusting timing of data output of the third band memory 206 and the fourth band memory 207 on the basis of the position signals of the detected marks 401 and 403 (step S11).

The timing control signals Ta and Tb generated by the printing position detection control portion 212 are fed to the third band memory 206 and the fourth band memory 207 (step S12). According to feeding timing, timings for outputting data from the third band memory 206 and the fourth band memory 207 to the third printing head 210 and the fourth printing head are adjusted. By this, ejection timings of inks from the third printing head 210 and the fourth printing head 211 can be controlled. Therefore, position offset of the printing positions on the front side surface and the back side surface in the carriage scanning directions Xa and Xb can be corrected.

Then, after correction of offset of the printing positions between the front side surface and the back side surface in the transporting direction Y and the carriage scanning directions Xa and Xb, the third printing head 210 and the fourth printing head 211 initiate printing of the image data. In the carriage scanning directions Xa and Xb, by performing printing in the opposite direction to that of the first print control portion 104, clear image with strike through can be produced. The decision whether the second print control portion 123 is operated for printing in the opposite direction to that of the first print control portion 104, is made depending upon sequential order to store the image data in the third band memory 206 and the fourth band memory 207.

As described above, it becomes possible to print the predetermined image on the front side surface of the printing medium and, in conjunction therewith, to print a mirror image of the image on the front side surface as viewed from the printed side, on the back side surface of the printing medium, with registration so that the image on the front side surface and the image on the back side surface are consistent with each other. By performing printing in the manner set forth above for the textile, it becomes possible to print the image by striking the ink through the textile.

Also, in the embodiment explained above, printing is performed on the front side surface of the printing medium and then printing is performed on the back side surface of the printing medium with registering the image on the back side surface with respect to the image on the front side surface.

However, the present invention is not limited to this specific embodiment. Alternatively, it is possible that printing is performed on the back side surface of the printing medium and then printing is performed on the front side surface of the printing medium with registering the image on the front side surface with respect to the image on the back side surface. Also, when the textile as the printing medium is such a type that the front and back side surfaces are not specified, printing is performed on one side surface of the printing medium and then printing is performed on the other side surface of the printing medium by registering the image on the other side surface with respect to the image on one side surface.

Figure 7A:
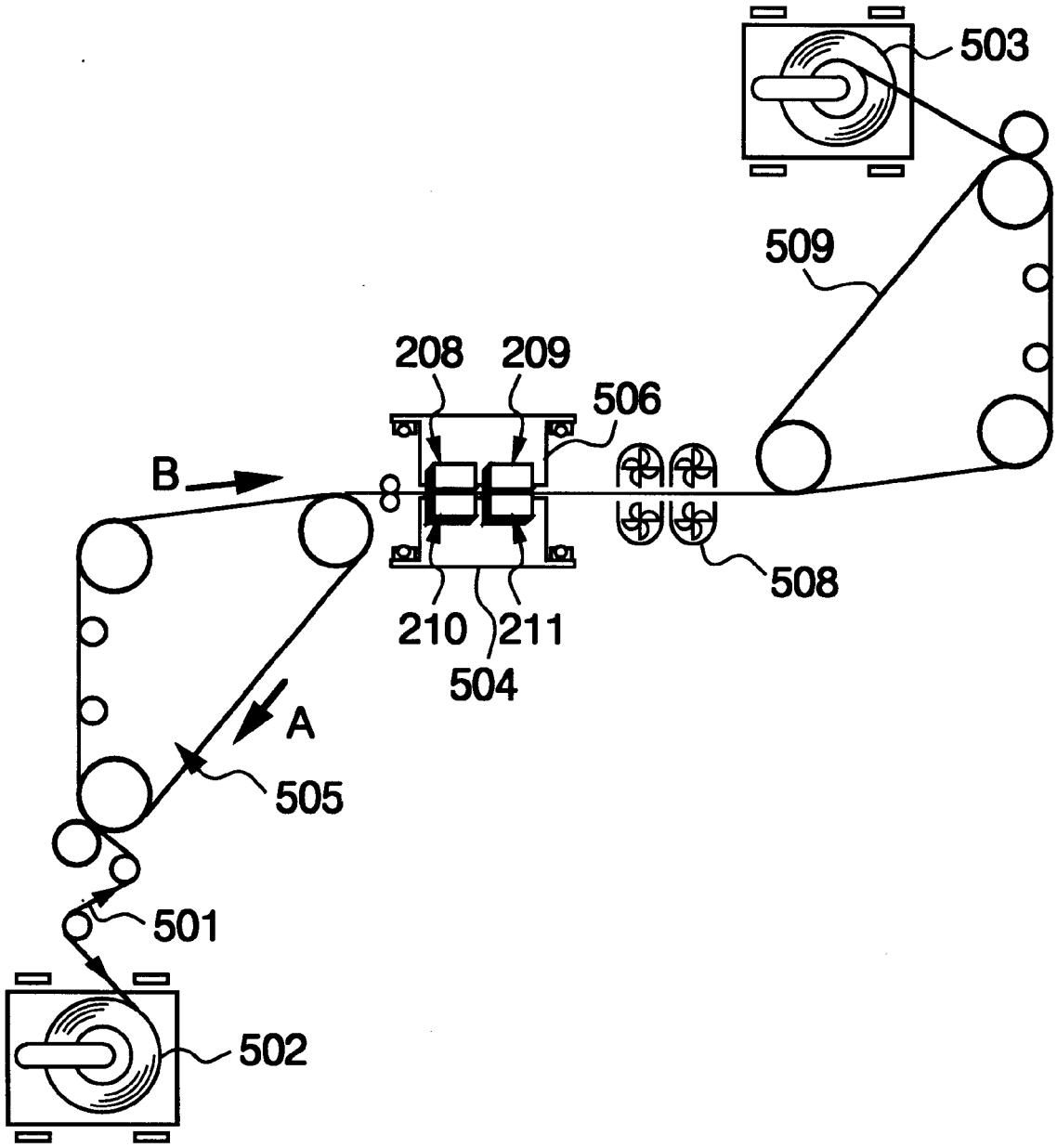
FIG. 7A is a sectional view and FIG. 7B is a plan view for showing a general construction of the full-color ink-jet textile printing apparatus as a second embodiment according to the present invention.
Figure 7B:
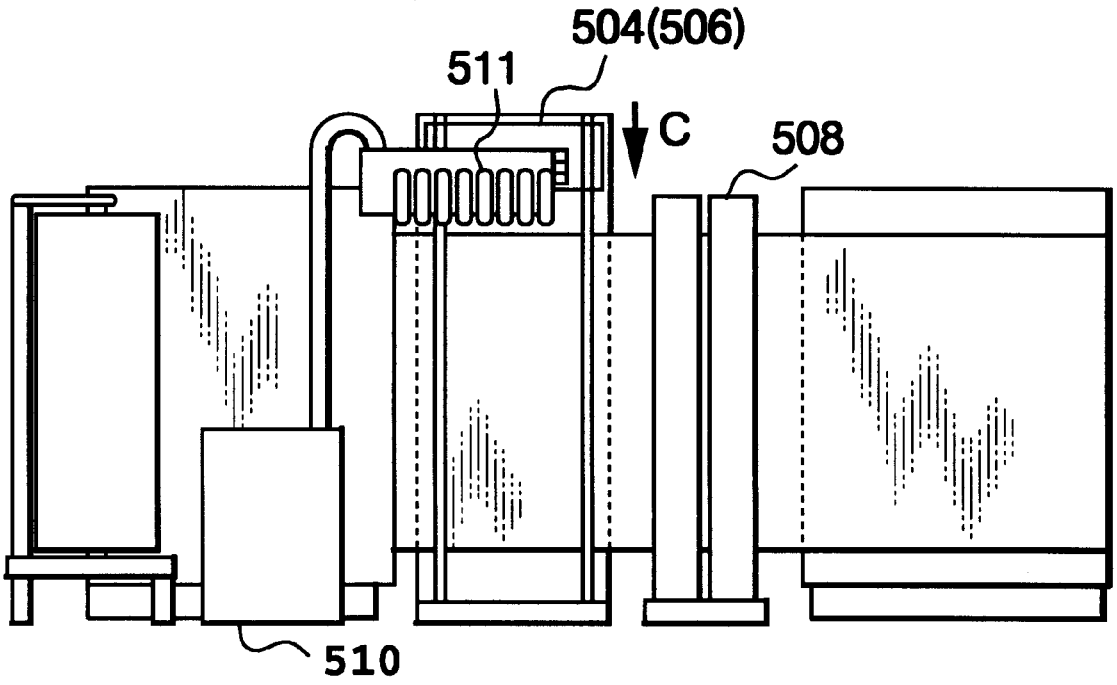

Next, the second embodiment of the present invention will be described with reference to FIGS. 7A and 7B. FIGS. 7A and 7B show a general construction of a full color ink-jet textile printing apparatus. In FIGS. 7A and 7B, the reference numeral 501 denotes a printing medium consisting of a textile, such as cotton, silk, nylon, polyester, and the like. The reference numeral 502 denotes a feed roller, on which the printing medium 501 is wound in roll form. The reference numeral 504 denotes a first print control portion which has a similar construction to that of the first print control portion 104 shown in FIG. 1. The reference numeral 505 denotes a first platen transporting the printing medium 501. The first platen 505 is stretched by a plurality of rollers and moves in the direction of arrow A to transport the printing medium 501 in the direction of arrow B by friction with the printing medium 501.

The reference numeral 506 denotes a second print control portion which has a similar construction to that of the second print control portion 123 of FIG. 1. After printing, the printing medium 501 is dried by a dryer 508. Thereafter, a second platen 509 for transporting the printing medium and preventing twisting, which second platen 509 is stretched by a plurality of rollers. Then, the printing medium 501 is taken up by a take-up roller 503 by friction with the printing medium 501.

The reference numeral 510 is a main ink tank and a pump device supplying a textile printing ink. The main ink tank and the pump device 510 supply the textile printing ink to a sub-tank 511 which moves together with the first printing head 504 and the second printing head 506 scanning in the direction of arrow C.

In this embodiment, in order to simultaneously performing printing on the front side surface and the back side surface, registration for double sided printing can be performed with a simple procedure.

Namely, registration for the double sided printing can be done by a complicated control method similar to the double sided printing process described with respect to the first embodiment with reference to FIG. 4. However, since the first and second print control portions 504 and 506 are arranged in opposition to each other, registration in this embodiment can be implemented with a simpler control method. For example, registration for double sided printing with respect to the carriage scanning direction Xa and Xb can be performed simply by detecting position offset of the reference marks by the sensors 404 and 406 of FIG. 4 and by controlling the ejection timing of the inks from the printing heads 208 to 211. On the other hand, registration for double sided printing in the transporting direction Y can be performed simply by manual adjustment employing an adjusting jig or the like or by controlling ejection timing of the ink from the printing heads 208 to 211.

By providing the sub-ink tank 511 movable together with the first and second printing heads 504 and 506, variation of the position energy of the ejection ink can be restricted to realize stable ejection.

The present invention is suitable for a printing apparatus of the type which forms flying liquid droplet utilizing thermal energy among the ink-jet printing systems to perform printing.

Subsequently, the description will be made of the entire processes of the ink jet textile printing. After the ink jet textile printing process is executed by the use of the above-mentioned ink jet printing apparatus, the textile is dried (including the natural dry). Then, in continuation, the dyestuff on textile fabric is dispersed, and a process is executed to cause the dyestuff to be reactively fixed to the fabric. With this process, it is possible for the printed textile to obtain a sufficient coloring capability and strength because of the dyestuff fixation.

For this dispersion and reactive fixation processes, the conventionally known method can be employed. A steaming method is named, for example. Here, in this case, it may be possible to give an alkali treatment to the textile in advance before the textile printing.

Then, in the post-treatment process, the removal of the non-reactive dyestuff and that of the substances used in the preparatory process are executed. Lastly, the defect correction, ironing finish, and other adjustment and finish processes are conducted to complete the textile printing.

Particularly, the following performatory characteristics are required for a textile suitable for the ink jet textile printing:

(1) Colors should come out on ink in a sufficient density.

(2) Dye fixation factor is high for ink.

(3) Ink must be dried quickly.

(4) The generation of irregular ink spread is limited.

(5) Feeding can be conducted in an excellent condition in an apparatus.

In order to satisfy these requirements, it may be possible to give a preparatory treatment to the textile used for printing, as required. In this respect, the textile having a receptacle layer is disclosed in Japanese Patent Application Laying-open No. 53492/1987, for example. Also, in Japanese Patent Application Publication No. 46589/1991, there is proposed a textile which contains reduction preventive agents or alkaline substances. As an embodiment of such preparatory treatment as this, it is also possible to use a process to allow the textile to contain a substance selected from an alkaline substance, water soluble polymer, synthetic polymer, water soluble metallic salt, or urea and thiourea.

As an alkaline substance, there can be named, for example, hydroxide alkali metals such as sodium hydroxide, potassium hydroxide; mono-, di-, and tori- ethanol amine, and other amines; and carbonate or hydrogen carbonate alkali metallic salt such as sodium carbonate, potassium carbonate, and sodium hydrogen carbonate. Furthermore, there are organic acid metallic salts such as calcium carbonate, barium carbonate or ammonia and ammonia compounds. Also, there can be used the sodium trichloroacetic acid and the like which become alkaline substances by steaming and hot air treatment. For an alkaline substance which is particularly suitable for the purpose, there are the sodium carbonate and sodium hydrogen carbonate which are used for dye coloring of the reactive dyestuffs.

As a water soluble polymer, there can be named starchy substances such as corn and wheat; cellulose substances such as carboxyl methyl cellulose, methyl cellulose, hydroxy ethel cellulose; polysaccharides such as sodium alginic acid, gum arabic, locasweet bean gum, tragacanth gum, guar gum, and tamarind seed; protein substances such as gelatin and casein; and natural water soluble polymers such as tannin and lignin.

Also, as a synthetic polymer, there can be named, for example, polyvinyl alcoholic compounds, polyethylene oxide compounds, acrylic acid water soluble polymers, maleic anhydride water soluble polymers, and the like. Among them, polysaccharide polymers and cellulose polymers should be preferable.

As a water soluble metallic salt, there can be named compounds with a pH level in the range of 4 to 10, which produce typical ionic crystals, for example, halogenoid compounds of alkaline metals or alkaline earth metals. As a typical embodiment of these compounds, NaCl, $Na_2SO_4$, KCl and $CH_3$ COONa and the like can be named for the alkaline metals, for example. Also, $CaCl_2$, $MgCl_2$, and the like can be named for the alkaline earth metals. Particularly, salt such as Na, K and Ca should be preferable.

The preparatory process is not necessarily confined to a particular method in order to enable the above-mentioned substances and others to be contained in the textile. Usually, however, a dipping method, padding method, coating method, spraying method, and others can be used.

Moreover, since the printing ink used for the ink jet textile printing merely remains to adhere to the textile when printed, it is preferable to perform a subsequent reactive fixation process (dye fixation process) for the dyestuff to be fixed on the textile. A reactive fixation process such as this can be a method publicly known in the art. There can be used a steaming method, HT steaming method, and thermofixing method, for example. Also, an alkaline pad steaming method, alkaline blotch steaming method, alkaline shock method, alkaline cold fixing method, and the like can be used when a textile is used without any alkaline treatment given in advance.

Further, the removal of the non-reactive dyestuff and the substances used in the preparatory process can be conducted by a rinsing method which is publicly known subsequent to the above-mentioned reactive fixation process. In this respect, it is preferable to conduct a conventional fixing treatment together when this rinsing is conducted.

In this respect, the printed textile is cut in desired sizes after the execution of the above-mentioned post process. Then, to the cut off pieces, the final process such as stitching, adhesion, and deposition is executed for the provision of the finished products. Hence, one-pieces, dresses, neckties, swimsuits, aprons, scarves, and the like, and bed covers, sofa covers, handkerchiefs, curtains, book covers, room shoes, tapestries, table textiles, and the like are obtained. Widely known methods of machine stitching can be used to make textiles and other daily needs.

As described above, according to the present invention, it is possible to obtain a high cleaning effect of the liquid discharging surface of the liquid discharging head as well as prolonged stability of the liquid discharging.

Thus, it is possible to produce the effect that the stable recovery can be executed even in a case where a highly viscous liquid is used or highly densified nozzles are employed, or further, an industrial use is required for a long time under severe conditions.

The present invention produces an excellent effect on an ink jet printing head and printing apparatus, particularly on those employing a method for utilizing thermal energy to form flying droplets for the printing.

Regarding the typical structure and operational principle of such a method, it is preferable to adopt those which can be implemented using the fundamental principle disclosed in the specifications of U.S. Pat. Nos. 4,723,129 and 4,740,796. Such a method is applicable to the so-called on-demand type printing system and a continuous type printing system. Particularly, however, it is suitable of the on-demand type because the principle is such that at least one driving signal, which provides a rapid temperature rise beyond a departure from nucleation boiling point in response to printing information, is applied to an electrothermal transducer disposed on a liquid (ink) retaining sheet or liquid passage whereby to cause the electrothermal transducer to generate thermal energy to produce film boiling on the thermoactive portion of the printing head; thus effectively leading to the resultant formation of a bubble in the printing liquid (ink) one to one for reach of the driving signals. By the development and contraction of the bubble, the liquid (ink) is discharged through a discharging port to produce at least one droplet. The driving signal is preferably in the form of pulses because the development and contraction of the bubble can be effectuated instantaneously, and, therefore, the liquid (ink) is discharged with quicker responses.

The driving signal in the form of pulses is preferably such as disclosed in the specifications of U.S. Pat. Nos. 4,463,359 and 4,345,262. In this respect, if the conditions disclosed in the specification of U.S. Pat. No. 4,313,124 regarding the rate of temperature increase of the heating surface are adopted, it is possible to perform an excellent printing in a better condition.

The structure of the printing head may be as shown in each of the above-mentioned specifications wherein the structure is arranged to combine the discharging ports, liquid passages, and electrothermal transducers, as also disclosed in the above-mentioned patents (linear type liquid passage or right angle liquid passage). Besides, it may be possible to form a structure such as disclosed in the specifications of U.S. Pat. Nos. 4,558,333 and 4,459,600 wherein the thermally activated portions are arranged in a curved area.

Furthermore, as a full line type printing head having a length corresponding to the maximum printing width, the present invention demonstrates the above-mentioned effect more efficiently with a structure arranged either by combining plural printing heads disclosed in the above-mentioned specifications or by a single printing head integrally constructed to cover such a length.

In addition, the present invention is effectively applicable to a replaceable chip type printing head which is connected electrically with the main apparatus and can be supplied with ink when it is mounted in the main assemble, or to a cartridge type printing head having an integral ink container.

Furthermore, as a printing mode for the printing apparatus, it is not only possible to arrange a monochromatic mode mainly with black, but also it may be possible to arrange an apparatus having at least one of multi-color mode with different color ink materials and a full-color mode using the mixture of the colors irrespective of the printing heads which are integrally formed as one unit or as a combination of plural printing heads. The present invention is extremely effective for such an apparatus as this.

Now, while the ink has been described as liquid, in the embodiments according to the present invention set forth above, it may be an ink material which is solidified below the room temperature but liquefied at the room temperature or may be liquid. Since the ink is controlled within the temperature not lower than 30° C. and not higher than 70° C. to stabilize its viscosity for the provision of the stable discharge in general, the ink may be such that it can be liquefied when the applicable printing signals are given.

In addition, while preventing the temperature rise due to the thermal energy by the positive use of such energy as an energy consumed for changing states of the ink from solid to liquid, or using the ink which will be solidified when left intact for the purpose of preventing ink evaporation, it may be possible to apply to the present invention the use of an ink having a nature of being liquefied only by the application of thermal energy. For example, an ink capable of being discharged as ink liquid by enabling itself to be liquefied anyway when the thermal energy is given in accordance with printing signals, an ink which will have already begun solidifying itself by the time it reaches a printing medium.

In addition, as modes of a printing apparatus according to the present invention, there are a copying apparatus combined with a reader and the like, and those adopting a mode as a facsimile apparatus having transmitting and receiving functions, besides those used as an image output terminal structured integrally or individually for an information processing apparatus such as a word processor and a computer.

The present invention is applicable for a system constructed from a plurality of devices and for an apparatus constructed with a simple device. On the other hand, needless to say, the present invention is applicable to a program implementing the present invention.

As set forth above, according to the present invention, with respect to the front side surface image formed on the front side surface of the printing medium by the first printing means, the back side surface image formed on the back side surface of the printing medium by the second printing means is formed as a mirror image symmetric about an axis in the transporting direction. Thus, clear image, in which images on both side surfaces are consistent, can be formed. Particularly, even when printing is performed in the ink-jet system employing a textile as the printing medium, printing with sufficient strike through can be performed. By this, the textile printing apparatus according to the present invention can be employed as a suitable apparatus for textile printing. Also, the sequential multi-scanning system effective for stripe or fluctuation can be realized at low cost.

Also, since a number of printing heads forming respective of the first printing means forming the front surface side image and second printing means forming the back surface side image is two stages at the maximum, the number of times of overlaying printing can be reduced to contribute for improvement of productivity. Furthermore, reduction of number of heads results in lowering of the cost of the apparatus.

What is claimed is:

1. An ink-jet printing apparatus for forming an image on a printing medium using a printing head, said apparatus comprising:

transporting means for transporting the printing medium;

first printing means, opposing one surface of the printing medium transported by said transporting means for forming an image on the one surface, at an image forming position, by applying a printing agent on the one surface of the printing medium using a printing head;

second printing means, opposing the other surface of the printing medium, and provided on a transporting path rearward of the image forming portion of said first printing means, for forming an image on the other surface by applying a printing agent on the other surface of the printing medium using a printing head; and registration control means for registering at least the image formed on the other surface relative to the image formed on the one surface of the printing medium by said first printing means, wherein said first printing means includes:

a carriage having printing heads with respect to a plurality of colors:

scanning means for moving said carriage, on one surface of said printing medium, in a forward direction different from a transporting direction of said printing medium, wherein said first printing means drives said printing heads to form an image during movement of said carriage by said scanning means; and wherein said second printing means includes:

a carriage having printing heads with respect to a plurality of colors;

scanning means for moving said carriage, on one surface of said printing medium, in a forward direction different from a transporting direction of said printing medium;

wherein said second printing means drives said printing heads to for an image during movement of said carriage by said scanning means; and wherein said registration control means includes means for registering an image position at least by said second printing means so that the position in said transporting direction is consistent with the position in said forward direction.

2. An ink-jet printing apparatus as claimed in claim 1, wherein said transporting means includes a first transporting means provided in opposition to the one surface of the printing medium and a second transporting means provided in opposition to the other surface of the printing medium; and said registration control means includes:

one surface reference mark printing means for forming a reference mark on the one surface of the printing medium;

the other surface reference mark printing means for forming a reference mark on the other surface of the printing medium;

reference mark detecting means for detecting the reference marks formed on the one and the other surfaces;

first control means for performing registration in a transporting direction of the printing medium by controlling a printing timing and said second transporting means on the basis of the positions of the detected reference marks; and second control means for performing registration in a scanning direction of the printing medium by controlling an ejection signal for said printing head in said second printing means on the basis of the positions of the detected reference marks.

3. An ink-jet printing apparatus as claimed in claim 1, wherein said printing heads of said first printing means include a first printing head and a second printing head arranged for shifting half of a head array width in the transporting direction with respect to said first printing head, and which apparatus further comprises:

means for performing printing for the head array width on one surface of the printing medium by performing scanning in a forward direction by said first printing head;

means for transporting the printing medium printed on a region corresponding to the width of the head array, in the transporting direction for a distance corresponding to the head array width;

first means for performing overlaying printing for half of the region printed on corresponding to the width of the head array by performing scanning of said second printing head in a reverse direction with respect to the printing medium transported in the distance corresponding to the head array width;

means for transporting the printing medium printed in overlaying manner for half of the region corresponding to the width of the head array, in the transporting direction for a distance corresponding to the head array width;

second means for performing overlaying printing for a remaining half of the region printed on corresponding to the width of the head array, and half overlay printed on by said first means for performing overlay printing, by performing scanning of said second printing head in a forward direction with respect to the printing medium transported in the distance corresponding to the head array width and printed in overlaying manner for half a region of the head array width.

4. An ink-jet printing apparatus as claimed in claim 1, wherein said printing heads of said second printing means include a third printing head and a fourth printing head arranged for shifting half of a head array width in the transporting direction with respect to said third printing head, and which apparatus further comprises:

means for performing printing for the head array width on the other surface of the printing medium by performing scanning in a forward direction by said third printing head;

means for transporting the printing medium printed on a region corresponding to the width of the head array, in the transporting direction for a distance corresponding to the head array width;

first means for performing overlaying printing for half of the region printed on corresponding to the width of the head array by performing scanning of said fourth printing head in a reverse direction with respect to the printing medium transported in the distance corresponding to the head array width;

means for transporting the printing medium printed in overlaying manner for half of the region corresponding to the width of the head array, in the transporting direction for a distance corresponding to the head array width;

second means for performing overlaying printing for a remaining half of the region printed on corresponding to the width of the head array, and half overlay printed on by said first means for performing overlay printing, by performing scanning of said fourth printing head in a forward direction with respect to the printing medium transported in the distance corresponding to the head array width and printed in overlaying manner for half region of the head array width.

5. An ink-jet printing apparatus as claimed in claim 2, which further comprises one and the other surface reversing means for reversing the one and the other surface of the printing medium with turning over a printing medium surface formed with the image on one surface, transported by said first transporting means, and directing to said second transporting means.

6. An ink-jet printing apparatus as claimed in claim 1, which further comprising drying means for drying the printing agent immediately after applying the printing agent on the one surface of the printing medium by said first printing means.

7. An ink-jet printing apparatus as claimed in claim 1, wherein said printing head comprises an ink-jet head performing printing by ejecting an ink.

8. An ink-jet printing apparatus as claimed in claim 1, wherein said printing head is a head ejecting in ink utilizing a thermal energy, and includes an element generating a thermal energy applied to the ink.

9. An ink-jet printing method comprising:

transporting step of transporting a printing medium;

image on one surface forming step of forming an image on one surface by applying a printing agent on the one surface of the printing medium transported in said transporting step at an image forming portion, using first printing means opposing one surface of the printing medium;

image on the other surface forming step of forming an image on the other surface of the printing medium by applying a printing agent on the other surface of the printing medium using second printing means opposing the other surface of the printing medium, wherein the second printing means is provided on a transporting path rearward of the image forming portion in said image on one surface forming step;

registration step of registering at least the image on the other surface of the printing medium relative to the image formed on the one surface of the printing medium by the first printing means, wherein said image on one surface forming step includes the step of:

moving said carriage having printing heads with respect to a plurality of colors, on one surface of said printing medium, in a forward direction different from a transporting direction of said printing medium to form an image;

wherein said image on the other surface forming step includes the step of:

moving said carriage having printing heads with respect to a plurality of colors, on one surface of said printing medium, in a forward direction different from a transporting direction by said printing medium to form an image; and wherein said registration step includes the step of:

registering an image position at least by said second printing means so that the position in said transporting direction is consistent with the position in said forward direction.

10. An ink-jet printing method as claimed in claim 9, wherein a first printing head and a second printing head arranged for shifting a half width of a head array width in a transporting direction with respect to the first printing head are employed as the first printing means, and a third printing head and a fourth printing head arranged for shifting a half width of a head array width in a transporting direction with respect to the third printing head are employed as the second printing means, said image on one surface forming step comprising the steps of:

performing printing for the head array width on the one surface of the printing medium by performing scanning in a forward direction by the first printing head;

transporting the printing medium printed on a region corresponding to the width of the head array, in the transporting direction for a distance corresponding to the head array width;

performing first overlaying printing for half of the region printed on corresponding to the width of the head array by performing scanning of the second printing head in a reverse direction with respect to the printing medium transported in the distance corresponding to the head array width;

transporting the printing medium printed in overlaying manner for half of the region corresponding to the width of the head array, in the transporting direction for a distance corresponding to the head array width;

performing second overlaying printing for a remaining half of the region printed on corresponding to the width of the head array, and half overlay printed in said step of performing first overlaying printing, by performing scanning of the second printing head in a forward direction with respect to the printing medium transported in the distance corresponding to the head array width and printed in overlaying manner for the half region of the head array width;

said image on the other surface forming step comprising the steps of:

performing printing for the head array width on the other surface of the printing medium by performing scanning in a forward direction by the third printing head;

transporting the printing medium printed on a region corresponding to the width of the head array, in the transporting direction for a distance corresponding to the head array width;

performing first overlaying printing for half of the region printed on corresponding to the width of the head array printed by performing scanning of the fourth printing head in a reverse direction with respect to the printing medium transported in the distance corresponding to the head array width;

transporting the printing medium printed in overlaying manner for half of the region corresponding to the width of the head array, in the transporting direction for a distance corresponding to the head array width;

performing second overlaying printing for a remaining half of the region printed on corresponding to the width of the head array, and half overlay printed on in said step of performing first overlay printing, by performing scanning of the fourth printing head in a forward direction with respect to the printing medium transported in the distance corresponding to the head array width and printed in overlaying manner for the half region of the head array width.

11. An ink-jet printing method as claimed in claim 9, wherein a first printing head and a second printing head arranged for shifting a half width of a head array width in a transporting direction with respect to the first printing head are employed as said first printing means, and a third printing head and a fourth printing head arranged for shifting a half width of a head array width in a transporting direction with respect to the third printing head are employed as the second printing means, said image on one surface forming step and said image on the other surface forming step comprising the steps of:

simultaneously performing printing of respective head array widths on the one surface and the other surface of the printing medium by scanning the first and third printing heads in forward direction;

transporting the printing medium printed on a region corresponding to the width of the head array on the one and the other surfaces, in the transporting direction for a distance corresponding to the head array width;

simultaneously performing first overlaying printing for half of the region printed on corresponding to the width of the head array by performing scanning of second and fourth printing heads in a reverse direction with respect to the printing medium transported in the distance corresponding to the head array width;

transporting the printing medium printed in overlaying manner for half of the region corresponding to the width of the head array on the one and the other surfaces, in the transporting direction for a distance corresponding to the head array width;

simultaneously performing second overlaying printing for a remaining half of the region printed on corresponding to the width of the head array, and half overlay printed in said step of performing first overlay printing, on the one and the other surfaces by performing scanning of the second and fourth printing heads in a forward direction with respect to the printing medium transported in the distance corresponding to the head array width and printed in overlaying manner for a half region of the head array width.

12. An ink-jet printing method as claimed in claim 9, wherein the printing heads comprises an ink-jet head for performing printing by ejecting an ink.

13. An ink-jet printing method as claimed in claim 9, wherein the printing heads are heads for ejecting an ink utilizing a thermal energy, and includes an element generating a thermal energy applied to said ink.

* * * * *

UNITED STATES PATENT AND TRADEMARK OFFICE

CERTIFICATE OF CORRECTION

PATENT NO. : 6,267,518 B1
DATED : July 31, 2001
INVENTOR(S) : Junkichi Abe

It is certified that error appears in the above-identified patent and that said Letters Patent is hereby corrected as shown below:

Title page,
Item [56], References Cited, FOREIGN PATENT DOCUMENTS,

"3-46589 12/1987 (JP).
52-12851 8/1993 (JP).
06055731 1 /1994 (JP).
90-70990 3/1997 (JP)." should read -- 62-346589 12/1987 (JP).
5-212851 8/1993 (JP).
6-055731 1/1994 (JP).
9-070990 3/1994 (JP). --.

Column 4,
Line 42, "forth" should read -- fourth --.

Column 5,
Line 1, "forth" should read -- fourth --;
Line 6, "forth" should read -- fourth --;
Line 7, "forth" should read -- fourth --;
Line 8, "forth" should read -- fourth --;
Line 9, "forth" should read -- fourth --;
Line 10, "forth" should read -- fourth --;
Line 11, "forth" should read -- fourth --;
Line 12, "forth" should read -- fourth --;
Line 13, "forth" should read -- fourth --;
Line 14, "forth" should read -- fourth --;
Line 15, "forth" should read -- fourth --;
Line 16, "forth" should read -- fourth --;
Line 17, "forth" should read -- fourth --;
Line 18, "forth" should read -- fourth --;
Line 19, "forth" should read -- fourth --;
Line 20, "forth" should read -- fourth --; and
Line 21, "forth" should read -- fourth --.

Column 9,
Line 51, "perform-" should read -- perform --; and
Line 52, "ing" should be deleted.

UNITED STATES PATENT AND TRADEMARK OFFICE

CERTIFICATE OF CORRECTION

PATENT NO. : 6,267,518 B1
DATED : July 31, 2001
INVENTOR(S) : Junkichi Abe

It is certified that error appears in the above-identified patent and that said Letters Patent is hereby corrected as shown below:

Column 10,
Line 59, "tori-" should read -- tri --.

Column 12,
Line 54, "assemble" should read -- assembly --.

Column 14,
Line 27, "for" should read -- form --.

Column 15,
Line 20, "width;" should read -- width; and --;
Line 28, "half a region" should read -- a half region --;
Line 57, "width;" should read -- width; and --;
Line 66, "half region" should read -- a half region --.

Column 17,
Line 51, "width;" should read -- width; and --.

Column 18,
Line 37, "width;" should read -- width; and --;
Line 50, "comprises" should read -- comprise --.

Signed and Sealed this

Fifth Day of March, 2002

*Attest:*

*Attesting Officer*

JAMES E. ROGAN
*Director of the United States Patent and Trademark Office*